US011857132B2

(12) United States Patent
Chandra et al.

(10) Patent No.: US 11,857,132 B2
(45) Date of Patent: Jan. 2, 2024

(54) CLEANING DEVICE

(71) Applicant: WHIRLPOOL CORPORATION, Benton Harbor, MI (US)

(72) Inventors: Sharath Chandra, Karnataka (IN); Vinod Dixit, Karnataka (IN); Nitin Minocha, New Delhi (IN); Chaitali Mohokar, Pune (IN); Eshita Pal, New Delhi (IN)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 17/584,874

(22) Filed: Jan. 26, 2022

(65) Prior Publication Data

US 2023/0233050 A1 Jul. 27, 2023

(51) Int. Cl.
*A47L 15/39* (2006.01)
*A47L 15/42* (2006.01)
(Continued)

(52) U.S. Cl.
CPC ..... *A47L 15/39* (2013.01); *A46B 13/02* (2013.01); *A46D 1/0207* (2013.01);
(Continued)

(58) Field of Classification Search
CPC .. A47L 15/0086; A47L 15/0068; A47L 15/24; A47L 15/37; A47L 15/39;
(Continued)

(56) References Cited

U.S. PATENT DOCUMENTS 5,581,836 A * 12/1996 Kleber ..... B08B 3/022 134/122 R
7,455,067 B1 * 11/2008 Cotton ..... A47L 15/0092 134/72
(Continued)

FOREIGN PATENT DOCUMENTS

CN 111904354 A * 11/2020 ..... A47L 15/0049
GB 2459298 A 10/2009
(Continued)

OTHER PUBLICATIONS

CN111904354—Machine Translation (Year: 2020).*
KR101281449—Machine Translation (Year: 2011).*

*Primary Examiner* — Lee D Wilson
*Assistant Examiner* — Alberto Saenz
(74) *Attorney, Agent, or Firm* — Price Heneveld LLP

(57) ABSTRACT

A cleaning device according to the present disclosure includes a first infinite belt assembly and a second infinite belt assembly disposed along a first plane and a second plane, respectively, where each plane is parallel to a longitudinal plane of the cleaning device. The second infinite belt assembly is disposed proximal to the first infinite belt assembly such that a gap is defined therebetween to receive a kitchen tool. Each of the first infinite belt assembly and the second infinite belt assembly includes bristles extending from respective outer surfaces to contact the kitchen tool. A water supply manifold of the device supplies water onto at least one of the kitchen tool, the infinite belts assemblies, and the gap. A drive unit counter rotates the first infinite belt assembly with respect to the second infinite belt assembly.

19 Claims, 7 Drawing Sheets

(51) Int. Cl.
*A46B 13/02* (2006.01)
*A46D 1/00* (2006.01)
*A47L 15/00* (2006.01)

(52) U.S. Cl.
CPC ..... *A47L 15/0086* (2013.01); *A47L 15/4214* (2013.01); *A46B 2200/3033* (2013.01)

(58) Field of Classification Search
CPC ..... A47L 15/42; A47L 15/247; A47L 15/248; A46B 13/04; A46B 2200/3033; A46D 1/0207; B08B 1/00; B08B 1/02; B08B 3/022; B08B 3/041; B08B 9/30; B08B 9/32; B65F 15/12; B65G 49/00; B65G 49/04; B65G 23/02
USPC ..... 15/22.3, 74, 77, 88.2; 134/48, 67, 68, 134/83, 124, 127
See application file for complete search history.

(56) References Cited

U.S. PATENT DOCUMENTS

| | | | |
|---|---|---|---|
| 2003/0131426 A1 | 7/2003 | Schulling | |
| 2015/0246378 A1 | 9/2015 | Clark | |
| 2018/0255991 A1 | 9/2018 | Der Marderosian et al. | |
| 2019/0116969 A1* | 4/2019 | Leary | A46B 13/04 |

FOREIGN PATENT DOCUMENTS

| | | | |
|---|---|---|---|
| GB | 2548067 A | | 9/2017 |
| KR | 101281449 B1 | * | 9/2011 |
| KR | 20200016462 A | | 2/2020 |
| SE | 1830122 A1 | | 11/2019 |
| WO | 2006/030472 A1 | | 3/2006 |

* cited by examiner

CLEANING DEVICE

TECHNICAL FIELD

The present disclosure relates, in general, to a cleaning device and, more specifically relates, to a cleaning device used to clean kitchen tools.

BACKGROUND

In a commercial or domestic kitchen, time is the essence. Keeping food preparation surfaces and utensils clean and sanitary is often a conflicting goal, since cleaning is a time consuming task. In particular, kitchen tools, such as knives, spoons, spatula, chopping board, and cutlery, must be kept absolutely clean and free from pathogens, which are almost universally present in uncooked meat and seafood, organic produce, and direct farm supplies. Multiple kitchen tools are often used in cooking process, and hence there is a need to wash them before and after every use to maintain cleanliness and hygiene. However, washing of multiple kitchen tools may disturb flow of other work in the kitchen and may lead to a high water consumption in order to eliminate presence of any sticky substance on the kitchen tools.

Swedish Patent Publication 1830122 discloses a dishwasher for washing kitchen tools, where water, steam, or detergent is supplied soon after a kitchen tool is introduced into the dishwasher. Further, a United Kingdom Patent Publication 2459298 discloses a cutlery cleaner that includes oscillating hard sponge pad cleaning system which contacts surface of the kitchen tool to perform cleaning process. U.S. Patent Publication 2003/131426 discloses a cleaning container that includes a set of brushes which are actuated to rotary motion when the kitchen tool is inserted into the cleaning container. However, these reference fail to disclose features which aid in achieving an efficient cleaning of kitchen tools besides providing easy maintenance of the cleaning device and reducing consumption of water.

SUMMARY

According to an aspect of the present disclosure, a cleaning device includes a body defining an inlet aperture configured to receive a kitchen tool therethrough, a first infinite belt assembly disposed along a first plane parallel to a longitudinal plane of the body and a second infinite belt assembly disposed along a second plane parallel to the longitudinal plane of the body. The second infinite belt assembly is positioned proximal to the first infinite belt assembly and defines a gap therebetween to receive the kitchen tool. Each of the first infinite belt assembly and the second infinite belt assembly includes a plurality of bristles extending from respective outer surfaces to contact the kitchen tool. The cleaning device also includes a water supply manifold to supply water onto at least one of the kitchen tool, the first infinite belt assembly, the second infinite belt assembly, and the gap. A drive unit of the cleaning device counter rotates the first infinite belt assembly with respect to the second infinite belt assembly.

In an embodiment, the cleaning device includes a corrugated portion defined on peripheral internal surfaces of the body. At least one of the first infinite belt assembly and the second infinite belt assembly is positioned proximal to the corrugated portion such that the corrugated portion contacts the plurality of bristles of the first infinite belt assembly or the second infinite belt assembly during operation of the cleaning device. In an embodiment, the cleaning device further includes a solenoid valve to regulate water supply to the water supply manifold. In an embodiment, the bristles of each of the first infinite belt assembly and the second infinite belt assembly is made of one of silicone or ethylene propylene diene monomer rubber. In an embodiment, the cleaning device is used in a dishwasher.

The present disclosure provides an improved cleaning device for cleaning kitchen tools. Particularly, the first infinite belt assembly and the second infinite belt assembly offers a large surface area coverage for large spatula or multiple tools in one go. The corrugated portion on the peripheral internal surface of the body provides a self-cleaning mechanism for the cleaning device, where clutter stuck to the bristles are removed when the bristles contact the corrugated portion during rotation of the first infinite belt assembly and the second infinite belt assembly. As such, cleaning of the kitchen tools and cleaning of the bristles are simultaneously performed, thereby largely reducing consumption of water.

These and other aspects and feature of non-limiting embodiments of the present disclosure will become apparent to those skilled in the art upon review of the following description of specific non-limiting embodiments of the disclosure in conjunction with the accompanying drawings.

BRIEF DESCRIPTION OF THE DRAWINGS

A better understanding of embodiments of the present disclosure (including alternatives and/or variations thereof) may be obtained with reference to the detailed description of the embodiments along with the following drawings, in which.

DETAILED DESCRIPTION

Reference will now be made in detail to specific embodiments or features, examples of which are illustrated in the accompanying drawings. Wherever possible, corresponding, or similar reference numbers will be used throughout the drawings to refer to the same or corresponding parts. Moreover, references to various elements described herein, are made collectively or individually when there may be more than one element of the same type. However, such references are merely exemplary in nature. It may be noted that any reference to elements in the singular may also be construed to relate to the plural and vice-versa without limiting the scope of the disclosure to the exact number or type of such elements unless set forth explicitly in the appended claims.

Figure 1:
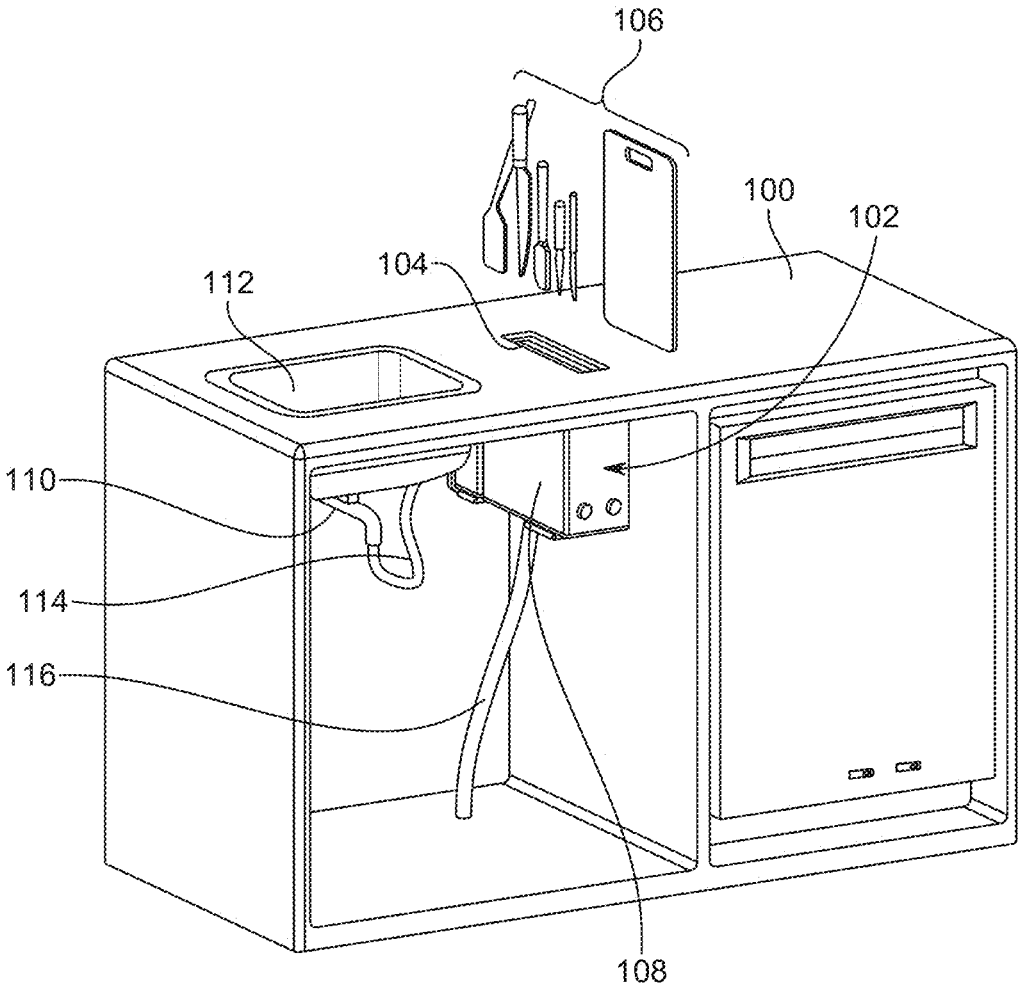
FIG. 1 is a perspective view of a kitchen countertop implementing a cleaning device.

Referring to FIG. 1, a perspective view of a countertop 100 implementing a cleaning device 102 (hereinafter referred to as "the device 102") is illustrated. Preferably, the device 102 is disposed beneath the countertop 100. The countertop 100 defines a tool insertion slit 104 that is designed to allow insertion of kitchen tools 106, such as cutleries, knives, spoons, spatula, cutting board, therethrough, such that an operation portion of the kitchen tools 106 is received within the tool insertion slit 104 while a handle portion of the kitchen tools remain outside the tool insertion slit 104, thereby making it accessible to a user. As used herein, the term "operation portion" refers to a portion of the kitchen tool that is used to execute a function associated with the kitchen tool. For example, a sharp metal portion of the knife may be referred to as the operation portion and a portion provided for the user to grip the knife may be referred to as the handle portion. Further, a body 108 of the device 102 defines an inlet aperture (not shown) that is aligned with the tool insertion slit 104, so that the operation portion of the kitchen tools 106 is received into the device 102. A water source 110 provides supply of water to a sink 112 and the device 102 simultaneously. Particularly, a water inlet pipe 114 extends between the water source 110 and the device 102. Further, an outlet pipe 116 extends from a base of the device 102 to drain dirt and wash water from the device 102.

Figure 2:
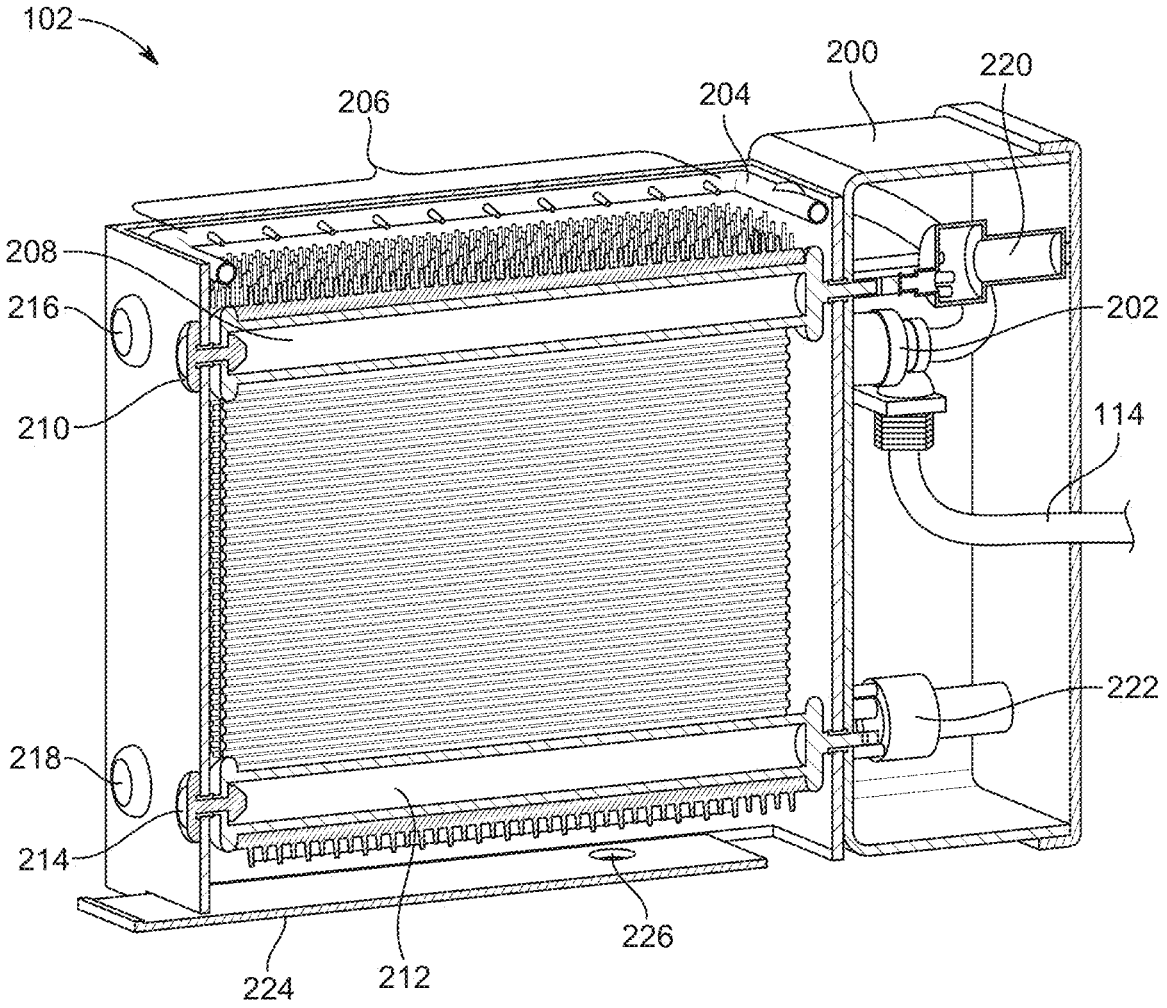
FIG. 2 is a cross-sectional view of the cleaning device of FIG. 1, according to an embodiment of the present disclosure.

FIG. 2 illustrates a cross-sectional view of the device 102, according to an embodiment of the present disclosure. The device 102 includes the body 108 and an operation chamber 200 coupled to the body 108. The water inlet pipe 114 is fluidly connected to a solenoid valve 202 configured to regulate supply of water to the body 108.

Further, the body 108 houses a water supply manifold 204 located at a top portion thereof and fluidly connected to the solenoid valve 202. As such, the solenoid valve 202 regulates the supply of water to the water supply manifold 204. The water supply manifold 204 includes a plurality of nozzles 206 extending in a direction inward with respect to walls of the device 102. In an aspect, the device 102 includes a first infinite belt assembly 207 (indicated in FIG. 3A) disposed along a first plane parallel to a longitudinal plane of the body 108 and a second infinite belt assembly 209 (indicated in FIG. 3A) disposed along a second plane parallel to the longitudinal plane of the body 108. The first infinite belt assembly 207 includes a first set of belt pulleys and a first infinite belt 304 (see FIG. 3A) extending around an outer circumferential surface of each belt pulley of the first set of belt pulleys. The first set of belt pulleys includes a first belt pulley 208 extending along a width of the body 108 and supported at ends thereof by walls of the body 108. For example, one end of the first belt pulley 208 is rotatably coupled to a first pulley support 210 and another end of the first belt pulley 208 is operably coupled to a first motor 220. Similarly, a second belt pulley 212, located distant from the first belt pulley 208, as shown in FIG. 2, extends along the width of the body 108 and is supported at ends thereof by the walls of the body 108. For example, one end of the second belt pulley 212 is rotatably coupled to a second pulley support 214 and another end is rotatably coupled to the wall of the body 108.

The second infinite belt assembly 209 includes a second set of belt pulleys (not shown in FIG. 2) and a second infinite belt 306 (see FIG. 3A) extending around an outer circumferential surface of each belt pulley of the second set of belt pulleys. Pulley supports 216, 218 correspond to location of belt pulleys of the second set of belt pulleys. A second motor 222 is operably coupled to one of the belt pulleys of the second set of belt pulleys. As used herein, the term "operably coupled" refers to an arrangement between the motor and the belt pulley that transfers torque from the motor to the belt pulley, thereby causing the belt pulley to rotate about its axis of rotation. As would be understood from FIG. 2, the axis of rotation of the belt pulleys would be defined by respective end supports thereof at the walls of the body 108. The first motor 220 and the second motor 222 together constitute a drive unit for the first set of belt pulleys and the second set of belt pulleys. Particularly, the drive unit is configured to counter rotate the first infinite belt assembly 207 with respect to the second infinite belt assembly 209. Preferably, the first motor 220 is configured to rotate the first set of belt pulleys in a first rotation direction, such as clockwise, and the second motor 222 is configured to rotate the second set of belt pulleys in a second rotation direction, such as anticlockwise. Simultaneously, the solenoid valve 202 supplies water to the water supply manifold 204, where jets of water is sprayed for cleaning the kitchen tool 106.

The device 102 further includes a base plate 224 slidably disposed at the base of the body 108. The base plate 224 may be selectively slid in a direction along the width of the device 102 and may be selectively detached from the body 108. An opening 226 defined in the base plate 224 fluidly connects the body 108 with the outlet pipe 116. Preferably, the base plate 224 may be configured to be accessed when all wash water injected by the nozzles 206 is drained through the opening 226.

Figure 3A:
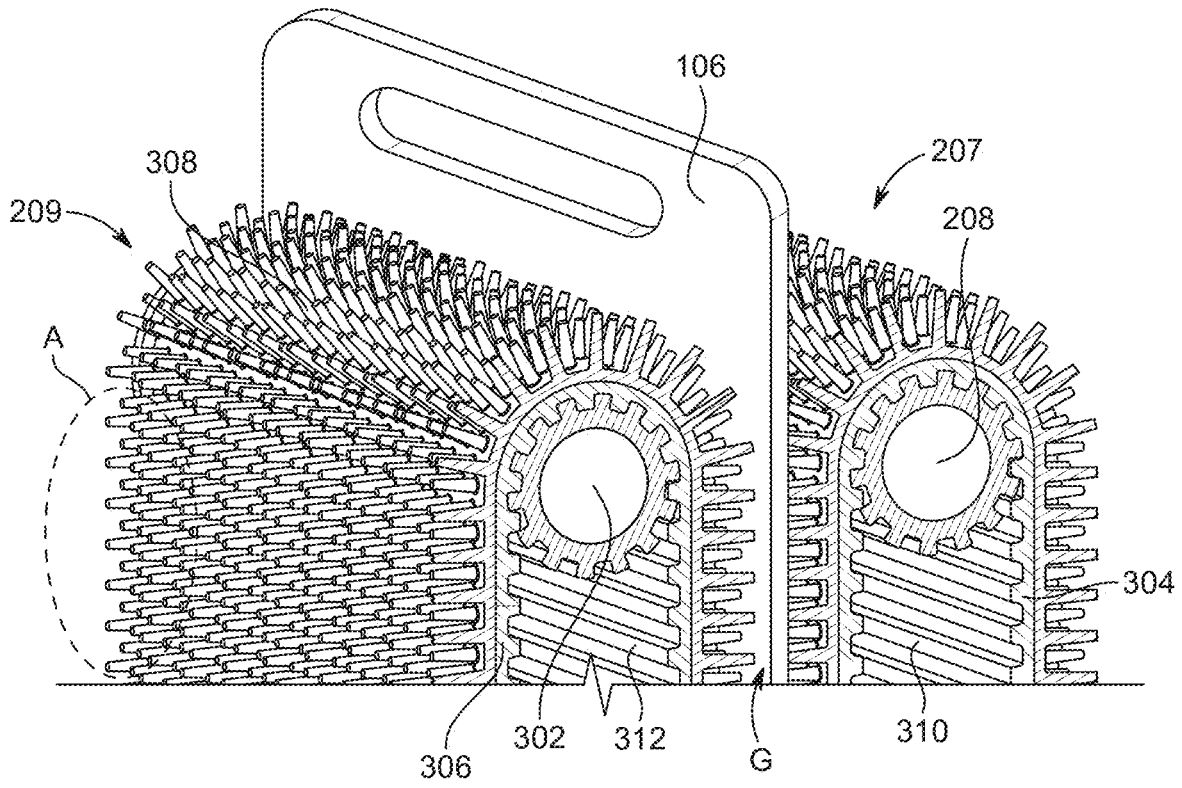
FIG. 3A is a perspective view of a portion of pair of belt pulleys of the cleaning device, according to an embodiment of the present disclosure.

FIG. 3A illustrates perspective view of a portion of pair of belt pulleys of the device 102. The first belt pulley 208 of the first set of belt pulleys includes multiple teeth at an outer circumferential surface thereof. Similarly, a first belt pulley 302 of the second set of belt pulleys includes multiple teeth at an outer circumferential surface thereof. Configuration of other belt pulleys (not shown in FIG. 3A) of the first set and the second set of belt pulleys are similar to the belt pulleys 208, 306. Advantageously, the first infinite belt assembly 207 is positioned proximal to the second infinite belt assembly 209 to define a gap "G" therebetween to receive the kitchen tool 106, such as the cutting board.

The first infinite belt 304 extends around the first belt pulley 208 and the second belt pulley 212; and the second infinite belt 306 extends around the first belt pulley 302 and a second belt pulley (not shown) of the second set of belt pulleys. As seen in FIG. 3A, an inner surface of each infinite belt includes teeth configured to mesh with teeth at the outer circumferential surface of respective belt pulleys. As such, during rotation of the belt pulleys by respective motors, the infinite belts remain secured around the belt pulleys by virtue of the meshing between respective teeth. Additionally, the inner surface of each infinite belt is made of high stiffness material which prevents buckling of the infinite belt.

Advantageously, each of the first infinite belt 304 and the second infinite belt 306 includes a plurality of bristles 308 extending from respective outer surfaces thereof. The bristles 308 are configured to contact the kitchen tool 106, such as the cutting board. In an embodiment, the bristles 308 are made of one of silicone or ethylene propylene diene monomer rubber, and hence associated with low stiffness. Therefore, the bristles 308 may freely bend during contact with the kitchen tool 106. Further, the nozzles 206 are suitably oriented such that the water jet impinges sufficiently on at least one of the infinite belt assemblies, the gap "G", and the kitchen tool 106. During cleaning of the kitchen tool 106, the bristles 308 clean the surface of the kitchen tool 106 by scrubbing action. Flexibility of the bristles 308 results in easy removal of clutter from the kitchen tool 106 in presence of flowing water. With such configuration, the device 102 may reduce cleaning time and consumption of water.

Figure 3B:
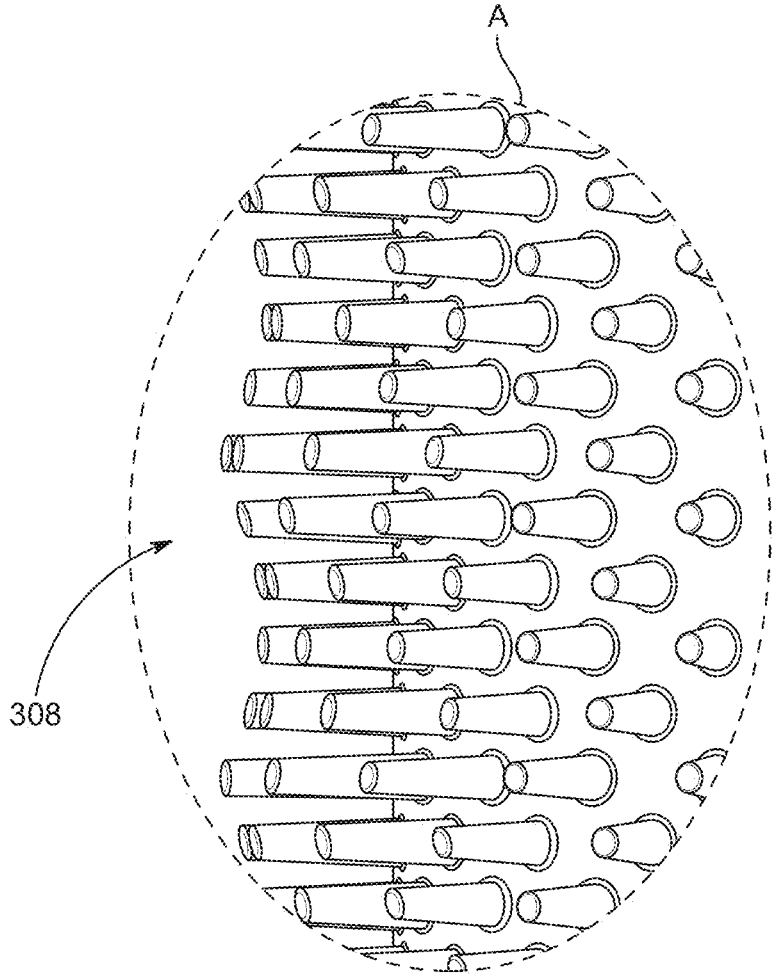
FIG. 3B is an enlarged view of a portion "A" of FIG. 3A, according to an embodiment of the present disclosure.

FIG. 3B illustrates an enlarged portion "A" of FIG. 3A. The infinite belts are designed such that peripheries of the bristles 308 define a zig-zag pattern or a wavy pattern as shown in FIG. 3B. Such configuration helps to efficiently clean the kitchen tools 106 having arcuate surfaces and multiple cutting edges. Flexibility of the bristles 308 combined with the zig-zag pattern achieves faster and deep cleaning of the kitchen tools 106.

Figure 4:
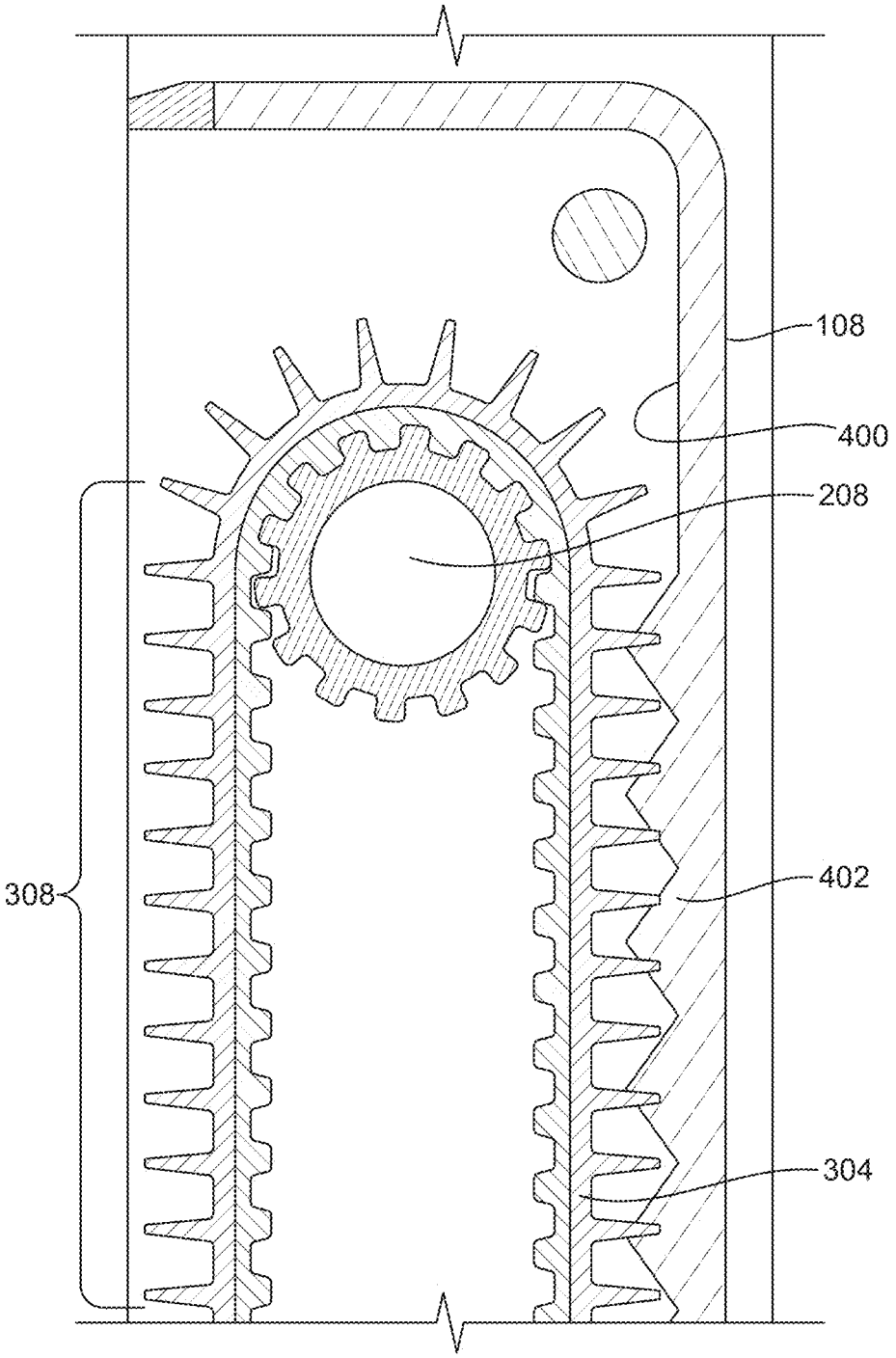
FIG. 4 is a cross-sectional view of a portion of the cleaning device, according to an embodiment of the present disclosure.

FIG. 4 illustrates a cross-sectional view of a portion of the device 102. In an advantageous embodiment, the device 102 includes a corrugated portion defined on peripheral internal surfaces of the body 108. At least one of the first infinite belt assembly 207 and the second infinite belt assembly 209 is positioned proximal to the corrugated portion. In the illustrated embodiment, the peripheral internal surface 400 of the body 108 includes the corrugated portion 402 defining a zig-zag pattern. During operation of the device 102, particularly during rotation of the first set of belt pulleys, the corrugated portion 402 is configured to contact the bristles 308 of the first infinite belt 304. Dirt and clutter carried by the bristles 308 may be cleaned from the bristles 308 when the corrugated portion 402 contacts the bristles 308. In the presence of water that is injected onto the infinite belts, cleaning of the bristles 308 may be easier. All the clutter and dirt from the bristles 308 flowing in the downward direction is either drained through the outlet pipe 116 or collected on the base plate 224 which may be cleaned manually by the user after completion of cleaning cycle. It will be understood that an opposite peripheral internal surface of the body 108 may include similar corrugated portion to help remove dirt and clutter from the bristles 308 of the second infinite belt 306. Therefore, combination of the corrugated portion 402 and the flexibility of the bristles 308 define a self-cleaning mechanism of the device 102 simultaneously with the cleaning of the kitchen tools 106, thus largely reducing consumption of water. Such self-cleaning mechanism also eliminates human efforts required to clean the device 102 after each cleaning cycle.

Figure 5:
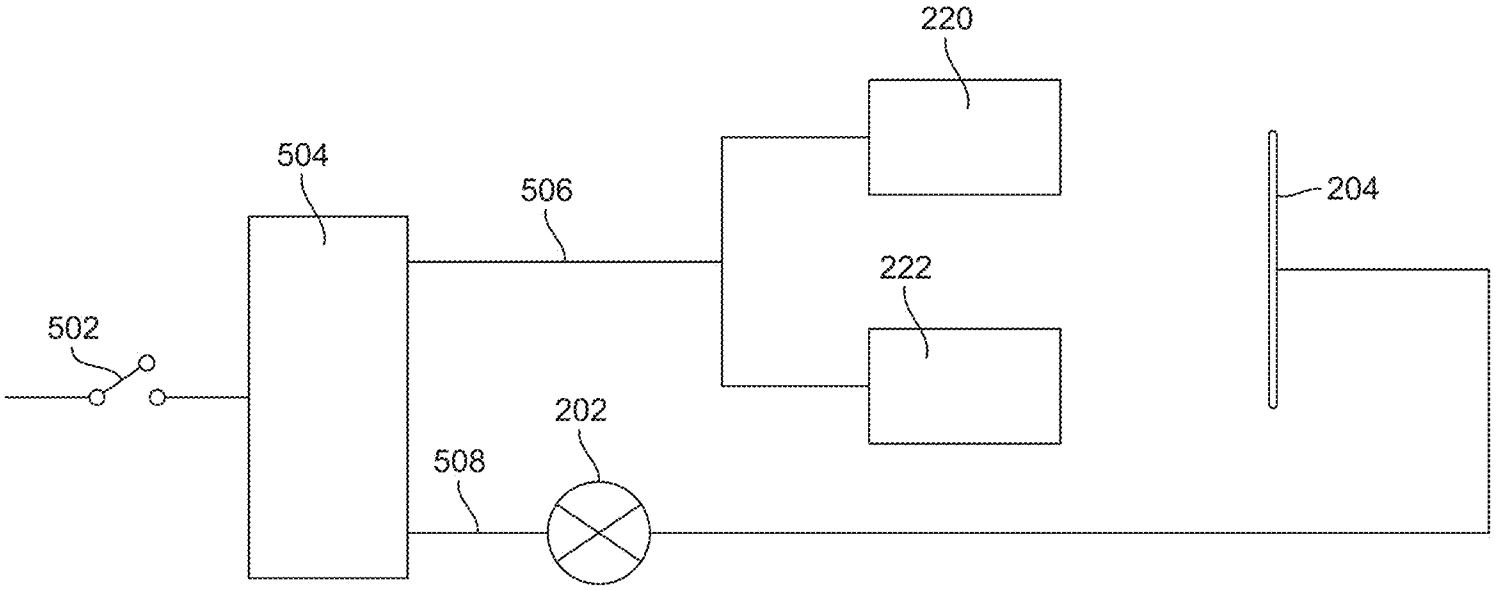
FIG. 5 is a schematic block diagram of the cleaning device, according to an embodiment of the present disclosure.

FIG. 5 illustrates a schematic block diagram of the device 102. Specifically, FIG. 5 will be described in conjunction with FIG. 1 through FIG. 4. In an embodiment, the device 102 includes a switch 502, such as a limit switch, (shown in OFF condition) electrically connected to a microcontroller 504. The switch 502 and the microcontroller 504 may be located in the operation chamber 200 of the device 102. The first motor 220 and the second motor 222 are connected to the microcontroller 504 via a first channel 506, and the solenoid valve 202 is connected to the microcontroller 504 via a second channel 508. As seen in FIG. 5, the first channel 506 and the second channel 508 extend parallel from the microcontroller 504. Such parallel connection may help balance the functionality of the device 102, both with respect to cleaning of the kitchen tools 106 and controlling supply of water to the water supply manifold 204.

In some embodiments, the microcontroller 504 may be implemented as a processor, such as one or more microprocessors, microcomputers, digital signal processors, central processing units, state machines, logic circuitries, or any devices that manipulate signals based on operational instructions. Among other capabilities the processor may be configured to fetch and execute computer-readable instructions stored in a memory thereof. Various functions of the processor may be provided using dedicated hardware as well as hardware capable of executing software in association with appropriate software. When provided by the processor, the functions may be provided by a single dedicated processor, by a single shared processor, or by a plurality of individual processors. Moreover, explicit use of the term "processor" should not be construed to refer exclusively to hardware capable of executing software, and may implicitly include, but not limited to, digital signal processor (DSP) hardware, network processor, application specific integrated circuit (ASIC), field programmable gate array (FPGA), read only memory (ROM) for storing software, random access memory (RAM), and non-volatile storage. Other hardware known to a person skilled in the art may also be included.

In operation, actuation of the switch 502 to ON condition provides electric supply to the microcontroller 504 which is configured to simultaneously actuate the motors 220, 222 and the solenoid valve 202. The microcontroller 504 is configured to actuate the first motor 220 to cause the first infinite belt 304 to rotate in the clockwise direction and actuate the second motor 222 to cause rotation of the second infinite belt 306 to rotate in anticlockwise direction. When the kitchen tool 106, such as the cutting board, is inserted through the tool insertion slit 104 defined in the countertop 100, the cutting board is received in the gap "G" and between the bristles 308 of the first infinite belt 304 and the second infinite belt 306. By virtue of the flexibility, the bristles 308 develop a scrubbing action against the surface of the cutting board, thereby removing dirt and substances from the surface. Any clutter present on the surface of the cutting board would be carried by the bristles 308 during movement of the infinite belts. Upon contacting the corrugated portion 402, the clutter and dirt may be discharged from the bristles 308, thereby rendering the bristles 308 clean for subsequent contact with the surface of the cutting board. Due to the large surface area of the infinite belts and rotation speed of the belt pulleys, cleaning of the cutting board may be achieved in short duration. Simultaneously, the microcontroller 504 controls the solenoid valve 202 to supply water to the water supply manifold 204. The nozzles 206 inject the jet of water onto at least one of the infinite belts, the kitchen tool 106, and the gap "G", thereby aiding faster cleaning of the cutting board and the bristles 308. Upon completion of the cleaning cycle, the switch 502 may be actuated to the OFF condition, where the electrical supply to the microcontroller 504 is ceased. As such, electrical supply to the motors 220, 222 and the solenoid valve 202 may be stopped simultaneously. In some embodiments, the microcontroller 504 may be configured to store a predefined amount of electrical charge, for example, in capacitors thereof, to operate the motors 220, 222 and the solenoid valve 202 for a predefined duration, for example 30 seconds. During such operation of the solenoid valve 202, water may be injected onto the infinite belts to remove any further remains of clutter or dirt from the bristles 308. Such operation helps to keep the device 102 ready for subsequent cleaning cycles. On completion of the predefined duration, the motors 220, 222 and the solenoid valve 202 are stopped.

Figure 6:
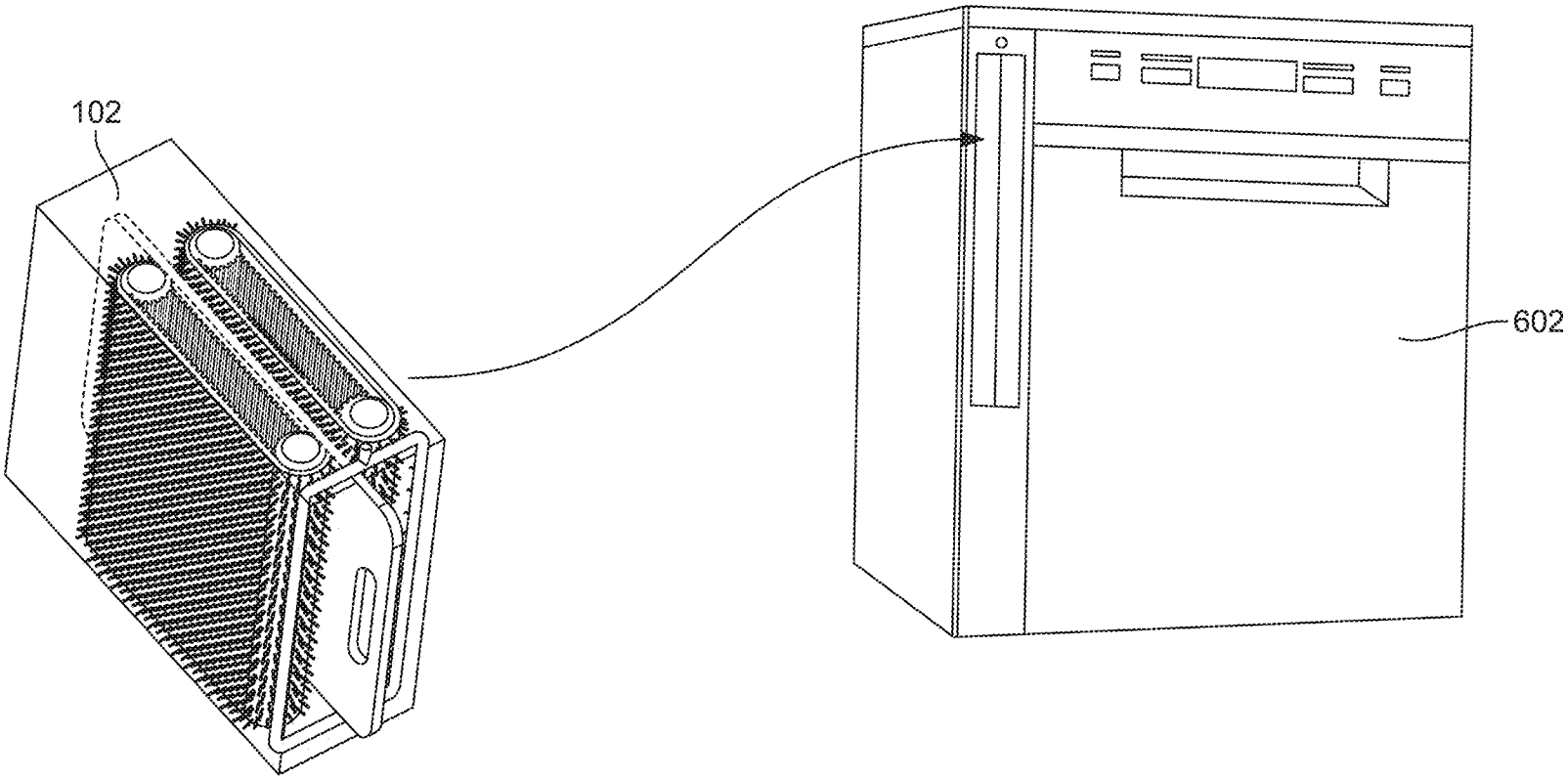
FIG. 6 is an exemplary illustration of implementation of the cleaning device into a dishwasher, according to an embodiment of the present disclosure.

FIG. 6 is an exemplary illustration of implementation of the device 102 into a dishwasher 602, according to an embodiment of the present disclosure. The device 102 may be operably disposed within the dishwasher 602. While the dishwasher 602 is used to clean large kitchen utensils, the device 102 can simultaneously clean the kitchen tools 106 at a same location, thereby reducing a total time the user may need to invest in cleaning the kitchen items. In some embodiments, the infinite belts may be detached, cleaned, and installed back into the device 102.

While aspects of the present disclosure have been particularly shown and described with reference to the embodiments above, it will be understood by those skilled in the art that various additional embodiments may be contemplated by the modification of the disclosed methods without departing from the spirit and scope of what is disclosed. Such embodiments should be understood to fall within the scope of the present disclosure as determined based upon the claims and any equivalents thereof.

What is claimed is:

1. A cleaning device comprising:

a body defining an inlet aperture configured to receive a kitchen tool therethrough;

a first infinite belt assembly disposed along a first plane parallel to a longitudinal plane of the body;

a second infinite belt assembly disposed along a second plane parallel to the longitudinal plane of the body, positioned proximal to the first infinite belt assembly, and defining a gap therebetween to receive the kitchen tool, wherein each of the first infinite belt assembly and the second infinite belt assembly comprises a plurality of bristles extending from respective outer surfaces, and wherein the plurality of bristles is configured to contact the kitchen tool;

a water supply manifold configured to supply water onto at least one of the kitchen tool, the first infinite belt assembly, the second infinite belt assembly, and the gap;

a drive unit configured to counter rotate the first infinite belt assembly with respect to the second infinite belt assembly; and a corrugated portion defined on peripheral internal surfaces of the body, wherein at least one of the first infinite belt assembly and the second infinite belt assembly is positioned proximal to the corrugated portion, the corrugated portion configured to contact the plurality of bristles of the first infinite belt assembly or the second infinite belt assembly during operation of the cleaning device.

2. The cleaning device of claim 1, further comprising a solenoid valve configured to regulate water supply to the water supply manifold.

3. The cleaning device of claim 1, wherein the plurality of bristles of each of the first infinite belt assembly and the second infinite belt assembly is made of one of silicone or ethylene propylene diene monomer rubber.

4. A dishwasher comprising a cleaning device of claim 1.

5. The cleaning device of claim 1, wherein the drive unit is further configured to rotate the first infinite belt assembly in a first direction and rotate the second infinite belt assembly in a second direction that is counter to the first direction.

6. The cleaning device of claim 5, wherein the drive unit includes a first motor driving the first infinite belt assembly and a second motor driving the second infinite belt assembly.

7. The cleaning device of claim 6, wherein the first infinite belt assembly includes a first pair of belt pulleys and the first infinite belt assembly extends around and is engaged with the first pair of belt pulleys, and wherein the second infinite belt assembly includes a second pair of belt pulleys and the second infinite belt assembly extends around and is engaged with the second pair of belt pulleys.

8. The cleaning device of claim 7, wherein the first motor is operably coupled with one of the first pair of belt pulleys and the second motor is operably coupled with one of the second pair of belt pulleys.

9. The cleaning device of claim 1, further including a base plate slidably disposed at a base of the body to facilitate cleaning.

10. The cleaning device of claim 9, wherein the base plate defines an opening configured to be fluidically connected to an outlet pipe.

11. A cleaning device comprising:

a body defining an inlet aperture configured to receive a kitchen tool therethrough;

a first infinite belt assembly disposed along a first plane;

a second infinite belt assembly disposed along a second plane, positioned proximal to the first infinite belt assembly, and defining a gap therebetween to receive the kitchen tool, wherein each of the first infinite belt assembly and the second infinite belt assembly comprises a plurality of bristles extending from respective outer surfaces, and wherein the plurality of bristles is configured to contact the kitchen tool;

a drive unit configured to counter rotate the first infinite belt assembly with respect to the second infinite belt assembly; and a corrugated portion defined on peripheral internal surfaces of the body, wherein at least one of the first infinite belt assembly and the second infinite belt assembly is positioned proximal to the corrugated portion, the corrugated portion configured to contact the plurality of bristles of the first infinite belt assembly or the second infinite belt assembly during operation of the cleaning device.

12. The cleaning device of claim 11, further comprising a solenoid valve configured to regulate water supply to a water supply manifold.

13. The cleaning device of claim 11, wherein the plurality of bristles of each of the first infinite belt assembly and the second infinite belt assembly is made of one of silicone or ethylene propylene diene monomer rubber.

14. A dishwasher comprising a cleaning device of claim 11.

15. The cleaning device of claim 11, wherein the drive unit includes a first motor driving the first infinite belt assembly and a second motor driving the second infinite belt assembly.

16. A cleaning device comprising:

a body defining an inlet aperture configured to receive a kitchen tool therethrough;

a first infinite belt assembly disposed along a first plane, a plurality of bristles extending from an outer surface of the first infinite belt, and wherein the plurality of bristles is configured to contact the kitchen tool;

a drive unit configured to counter rotate the first infinite belt assembly; and a corrugated portion defined on peripheral internal surfaces of the body, wherein the first infinite belt assembly is positioned proximal to the corrugated portion, the corrugated portion configured to contact the plurality of bristles of the first infinite belt assembly during operation of the cleaning device.

17. The cleaning device of claim 16, further including a second infinite belt assembly disposed along a second plane, positioned proximal to the first infinite belt assembly, and defining a gap therebetween to receive the kitchen tool, wherein the second infinite belt assembly includes a plurality of bristles extending from an outer surface of the second infinite belt assembly, and wherein the plurality of bristles on the second infinite belt assembly is configured to contact the kitchen tool.

18. The cleaning device of claim 17, further including a water supply manifold configured to supply water onto at least one of the kitchen tool, the first infinite belt assembly, the second infinite belt assembly, and the gap.

19. A dishwasher comprising a cleaning device of claim 16.

* * * * *